US008646436B2

(12) United States Patent
Wakabayashi et al.

(10) Patent No.: US 8,646,436 B2
(45) Date of Patent: Feb. 11, 2014

(54) FUEL PUMP ATTACHMENT STRUCTURE

(75) Inventors: Keisuke Wakabayashi, Kariya (JP); Yoshiaki Sumiya, Hekinan (JP); Hirotsugu Kojima, Nagoya (JP); Shuji Yamaguchi, Toyokawa (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 284 days.

(21) Appl. No.: 13/173,227

(22) Filed: Jun. 30, 2011

(65) Prior Publication Data

US 2012/0006304 A1 Jan. 12, 2012

(30) Foreign Application Priority Data

Jul. 6, 2010 (JP) ..... 2010-153893
Jul. 6, 2010 (JP) ..... 2010-153894

(51) Int. Cl.
*F02M 37/04* (2006.01)

(52) U.S. Cl.
USPC ..... 123/509

(58) Field of Classification Search
USPC ..... 123/508, 509
See application file for complete search history.

(56) References Cited

U.S. PATENT DOCUMENTS 4,054,108 A * 10/1977 Gill ..... 123/509
4,760,831 A * 8/1988 Altdorf ..... 123/509
5,007,401 A * 4/1991 Grohn et al. ..... 123/509
5,603,303 A * 2/1997 Okajima et al. ..... 123/508
7,814,891 B2 * 10/2010 Lee et al. ..... 123/508
8,127,747 B2 * 3/2012 Ahn ..... 123/508
8,302,574 B2 * 11/2012 Ahn ..... 123/508
8,307,799 B2 * 11/2012 Shin ..... 123/90.33
2003/0056758 A1 * 3/2003 Onishi et al. ..... 123/509
2004/0139939 A1 * 7/2004 Tsubouchi ..... 123/508
2009/0151704 A1 * 6/2009 Lee et al. ..... 123/508
2011/0052427 A1 * 3/2011 Shaull et al. ..... 123/508
2011/0126793 A1 * 6/2011 Ahn ..... 123/196 R
2011/0146626 A1 * 6/2011 Maruyama et al. ..... 92/165 R
2011/0253109 A1 * 10/2011 Usui et al. ..... 123/509

FOREIGN PATENT DOCUMENTS

JP 2000-291503 10/2000
JP 2007-107387 4/2007
JP 2009-167809 7/2009

OTHER PUBLICATIONS

Japan Office action, mail date is Oct. 29, 2013.

* cited by examiner

*Primary Examiner* — Stephen K Cronin
*Assistant Examiner* — Arnold Castro
(74) *Attorney, Agent, or Firm* — Greenblum & Bernstein, P.L.C.

(57) ABSTRACT

A fuel pump attachment structure is provided that includes a cylinder head; a cylinder head cover joined to a top surface of the cylinder head; a bracket mounted to the top surface of the cylinder head so as to be located at a position outside the cylinder head cover; and a fuel pump attached to the bracket. The fuel pump is inserted into an opening formed in the cylinder head cover. A sealing member is arranged between an outer surface of the fuel pump and a surface of the cylinder head cover that defines the opening. Alternatively, a pressing portion is formed in a lower portion of the bracket. The pressing portion presses a pressed portion formed on a periphery of the cylinder head cover from above by means of a bolt that is inserted into the pressing portion and fastened to the cylinder head.

13 Claims, 7 Drawing Sheets

Fig.2
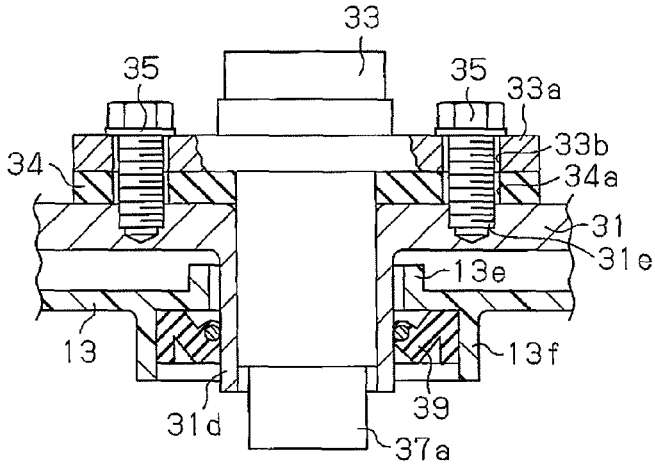
Fig.3(a)
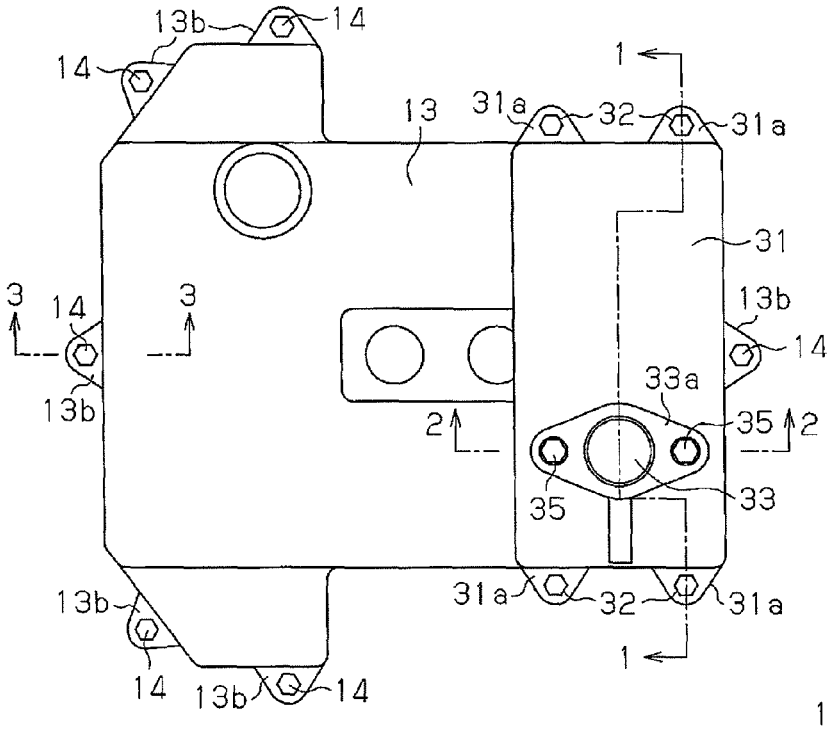
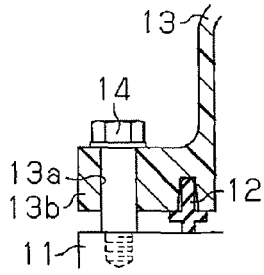
Fig.3(b)

FUEL PUMP ATTACHMENT STRUCTURE

BACKGROUND OF THE INVENTION

The present invention relates to a structure for attaching a fuel pump to a cylinder head of an engine. The fuel pump pressurizes fuel through, for example, rotation of an intake or exhaust camshaft and supplies the pressurized fuel to a pressure accumulation pipe of the engine.

FIGS. 11 and 12 show an example of this type of fuel pump attachment structure. The fuel pump attachment structure illustrated in the drawings includes an attachment base 71, which is formed integrally with and arranged on a metal cylinder head cover 13. A fuel pump 33 is received in a central hole 71*a* formed in the attachment base 71. A sealing member 34 is arranged between a flange 33*a* of the fuel pump 33 and the top surface of the attachment base 71. Bolts 35, which extend through the flange 33*a* and the sealing member 34, is each threadably received in a corresponding one of threaded holes 71*b* of the attachment base 71, thus attaching the fuel pump 33 to the cylinder head cover 13.

The fuel pump 33 has a pressurizing cylinder 36. A plunger 37 is received in the pressurizing cylinder 36. A tappet 37*a* is connected to the lower end of the plunger 37. A pump drive cam 38 is formed in an exhaust camshaft 21 at the position corresponding to the tappet 37*a*. As the pump drive cam 38 rotates integrally with the exhaust camshaft 21, the plunger 37 reciprocates in the upward-downward direction in the pressurizing cylinder 36. Through such reciprocation of the plunger 37, fuel in the fuel pump 33 is pressurized and supplied to a pressure accumulation pipe such as a common rail in the engine. After having been sent to the pressure accumulation pipe, the fuel is injected into a combustion chamber in the engine through a fuel injection valve.

In the fuel pump attachment structure shown in FIGS. 11 and 12, the cam 38 repeatedly applies great external force to the fuel pump 33. The cylinder head cover 13 thus must be formed of metal such as iron or aluminum alloy, and the weight of the engine is increased.

Japanese Laid-Open Patent Publication No. 2000-291503 discloses a fuel pump attachment structure described below. Specifically, a metal bracket is mounted on a cylinder head in a manner covered by a cylinder head cover formed of synthetic resin. A fuel pump is attached to and supported by the bracket. When the fuel pump is driven by a pump drive cam, the cylinder head cover does not receive great external force. The weight of the cylinder head cover can thus be reduced. However, the fuel pump attachment structure of Japanese Laid-Open Patent Publication No. 2000-291503 has two problems as will be described below.

The first problem is that there is not sufficient space for installing the bracket between the cylinder head cover and the cylinder head. This makes it difficult to mount the bracket on the cylinder head or to attach the fuel pump to the bracket. To avoid this problem, the fuel pump may be attached to and supported by the cylinder head cover instead of the bracket. However, in this case, the cylinder head cover, which is formed of synthetic resin, must be reinforced. This may bring about an additional problem. The second problem is that, since the bracket is received between the cylinder head cover and the cylinder head, a great number of bolts must be employed to fix the cylinder head cover and the bracket to the top surface of the cylinder head. This also complicates operation for attaching the fuel pump.

SUMMARY OF THE INVENTION

Accordingly, it is an objective of the present invention to provide a fuel pump attachment structure that decreases the weight of a cylinder head cover, increases the flexibility in installation of a bracket, and facilitates attaching of a fuel pump to a cylinder head.

To achieve the foregoing objective and in accordance with one aspect of the present invention, a fuel pump attachment structure is provided that includes a cylinder head; a cylinder head cover joined to a top surface of the cylinder head; a bracket mounted to the top surface of the cylinder head so as to be located at a position outside the cylinder head cover; and a fuel pump attached to the bracket. The fuel pump is inserted into an opening formed in the cylinder head cover. A sealing member is arranged between an outer surface of the fuel pump and a surface of the cylinder head cover that defines the opening.

In accordance with another aspect of the present invention, a fuel pump attachment structure is provided that includes a cylinder head; a cylinder head cover joined to a top surface of the cylinder head; a bracket mounted to the top surface of the cylinder head so as to be located at a position outside the cylinder head cover; and a fuel pump attached to the bracket. A pressing portion is formed in a lower portion of the bracket. The pressing portion presses a pressed portion formed on a periphery of the cylinder head cover from above by means of a bolt that is inserted into the pressing portion and fastened to the cylinder head.

Other aspects and advantages of the invention will become apparent from the following description, taken in conjunction with the accompanying drawings, illustrating by way of example the principles of the invention.

BRIEF DESCRIPTION OF THE DRAWINGS

FIG. 2 is a cross-sectional view taken along line 2-2 of FIG. 3(*a*);

FIG. 3(*a*) is a plan view showing a cylinder head cover, a bracket, and a fuel pump of the fuel pump attachment structure illustrated in FIG. 1;

FIG. 3(*b*) is a cross-sectional view taken along line 3-3 of FIG. 3(*a*);

FIG. 7(*b*) is a cross-sectional view showing an attachment portion of the bracket illustrated in FIG. 7(*a*);

DETAILED DESCRIPTION OF THE PREFERRED EMBODIMENTS

First Embodiment

A first embodiment of the present invention will now be described with reference to FIGS. 1 to 3(*b*).

Figure 1:
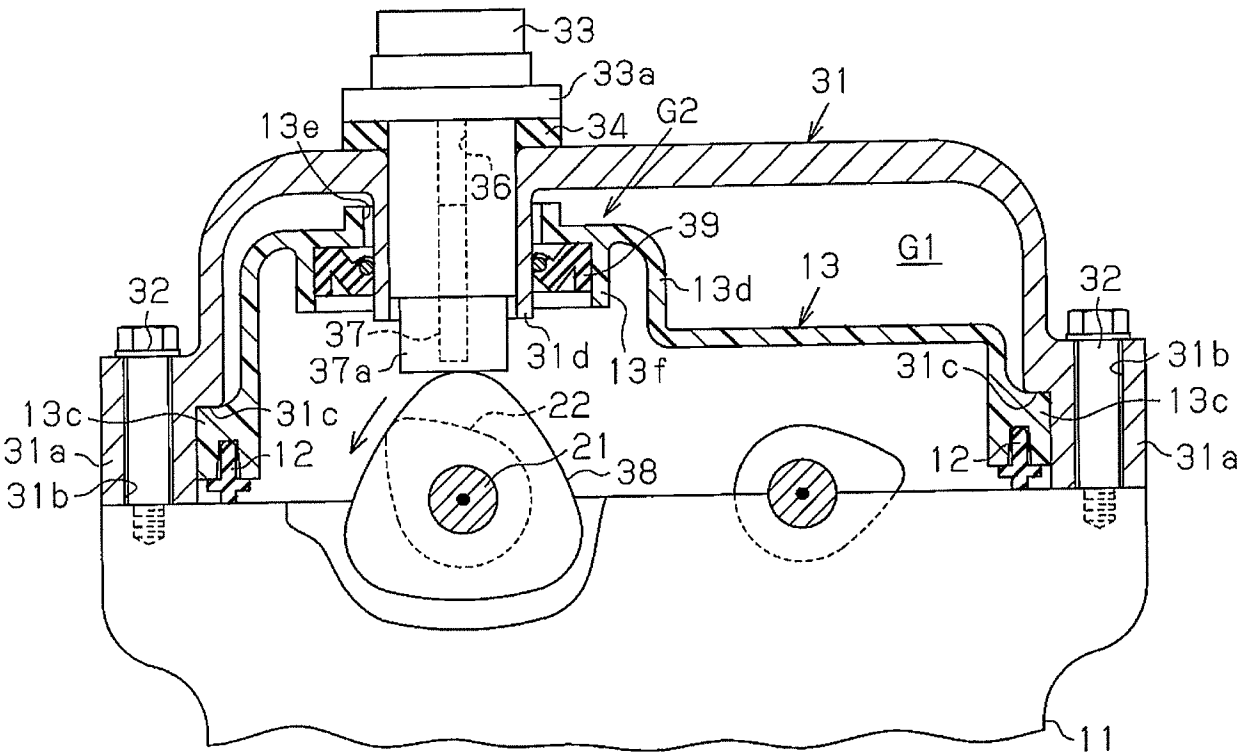
FIG. 1 is a cross-sectional view taken along line 1-1 of FIG. 3(*a*), showing a fuel pump attachment structure according to a first embodiment of the present invention.

As shown in FIG. 1, a cylinder head cover 13 is joined to the top surface of a cylinder head 11 through a gasket 12. With reference to FIGS. 3(*a*) and 3(*b*), the cylinder head cover 13 is fastened and fixed to the cylinder head 11 by means of a plurality of shoulder bolts 14. More specifically, a plurality of attachment portions 13*b* are formed integrally with and arranged on the periphery of the cylinder head cover 13. The bolts 14 are inserted into corresponding through holes 13*a* formed in the attachment portions 13*b*, and threadably secured to the cylinder head 11. The cylinder head cover 13 is thus mounted on the cylinder head 11. In this configuration, the gasket 12 is compressed by the attachment portions 13*b*.

With reference to FIG. 1, a bracket 31 is mounted on and fastened to the cylinder head 11 by means of a plurality of (in the first embodiment, four) bolts 32. The bracket 31 is formed of metal such as aluminum alloy or magnesium alloy and has a substantially rectangular shape as viewed from above. As illustrated in FIG. 3(*a*), two attachment portions 31*a* are formed at one end of the bracket 31 with another two attachment portions 31*a* arranged at the opposite end of the bracket 31. Each of the bolts 32 is inserted into a through hole 31*b* formed in a corresponding one of the attachment portions 31*a*. The attachment portions 31*a* are formed integrally with the bracket 31. Stepped surfaces 31*c* (pressing portions) are formed on the inner surface of the bracket 31. The stepped surfaces 31*c* are arranged at positions corresponding to stepped portions 13*c* (pressed portions), which are formed on the periphery of the cylinder head cover 13. The stepped portions 13*c* are formed integrally with the cylinder head cover 13. Since the bracket 31 is fastened to the cylinder head 11 by means of the bolts 32 and thus pressed against the cylinder head 11, the stepped portions 13*c* of the cylinder head cover 13 are depressed by the corresponding stepped surfaces 31*c* of the bracket 31. As a result, the gasket 12 is further compressed. The cylinder head cover 13 and the bracket 31 are fastened and fixed together to the cylinder head 11 by means of the bolts 32. In other words, the bolts 14 are employed exclusively to fix the cylinder head cover 13 to the cylinder head 11, while the bolts 32 are used to fix the cylinder head cover 13 and the bracket 31 together to the cylinder head 11.

As illustrated in FIG. 1, the bracket 31 has a cylindrical attachment tubular portion 31*d*, which extends downward from the inner surface of the bracket 31. The attachment tubular portion 31*d* is formed integrally with the bracket 31. The attachment tubular portion 31*d* has a through hole, which extends in the upward-downward direction. A fuel pump 33 is inserted into the through hole of the attachment tubular portion 31*d*. The fuel pump 33 has a flange 33*a* formed integrally with an upper portion of the fuel pump 33. A sealing member 34 is arranged between the lower surface of the flange 33*a* and the top surface of the bracket 31. The sealing member 34 seals the gap between the outer peripheral surface of the fuel pump 33 and the inner peripheral surface of the attachment tubular portion 31*d*. With reference to FIG. 2, bolt insertion holes 33*b* are formed in the flange 33*a*, and bolt insertion holes 34*a* are formed in the sealing member 34. A bolt 35 is inserted into each of the bolt insertion holes 33*b* and a corresponding one of the bolt insertion holes 34*a*, and threadably received in a corresponding one of threaded holes 31*e* formed in the bracket 31. The fuel pump 33 is thus fixed to the bracket 31.

With reference to FIG. 1, a bulging portion 13*d* is formed on the outer surface of the cylinder head cover 13. The bulging portion 13*d* is formed integrally with the cylinder head cover 13. An opening 13*e* is formed at the center of the bulging portion 13*d* to receive the attachment tubular portion 31*d* of the bracket 31. When the attachment tubular portion 31*d* is inserted into the opening 13*e*, a clearance exists between the outer peripheral surface of the attachment tubular portion 31*d* and the surface of the cylinder head cover 13 that defines the opening 13*e*. An accommodation tubular portion 13*f* is projected from the inner surface of the bulging portion 13*d*. The accommodation tubular portion 13*f* is formed integrally with the bulging portion 13*d*. The accommodation tubular portion 13*f* is arranged coaxially with the opening 13*e* and has a diameter greater than the diameter of the opening 13*e*. A sealing member 39 is arranged between the inner peripheral surface of the accommodation tubular portion 13*f* and the outer peripheral surface of the attachment tubular portion 31*d*. The sealing member 39 seals the gap between the attachment tubular portion 31*d* and the accommodation tubular portion 13*f*. The first space G1 between the top surface of the portion of the cylinder head cover 13 other than the bulging portion 13*d* and the lower surface of the bracket 31 is larger than the second space G2 between the top surface of the bulging portion 13*d* and the lower surface of the bracket 31.

As illustrated in FIG. 1, the fuel pump 33 has a pressurizing cylinder 36, which is provided in a lower portion of the fuel pump 33. A plunger 37 is received in the pressurizing cylinder 36. A tappet 37*a* is connected to the lower end of the plunger 37. A pump drive cam 38 is provided in an exhaust camshaft 21 at the position corresponding to the tappet 37*a*. As the pump drive cam 38 rotates in the direction indicated by the arrow in FIG. 1, the plunger 37 reciprocates in the upward-downward direction in the pressurizing cylinder 36, thus performing a pumping operation.

Operation of an engine in which the fuel pump 33 is attached to the cylinder head 11 in the above-described manner will hereafter be described.

When the engine is running, the plunger 37 and the tappet 37*a* of the fuel pump 33 are reciprocated in the upward-downward direction through rotation of the pump drive cam 38, which rotates integrally with the exhaust camshaft 21. This pressurizes fuel in the fuel pump 33 and supplies the pressurized fuel to a pressure accumulation pipe such as a common rail in the engine. After having been sent to the pressure accumulation pipe, the fuel is injected into a combustion chamber in the engine through a fuel injection valve.

The fuel pump attachment structure according to the first embodiment, which has been described above, has the advantages described below.

In the first embodiment, the bracket 31 to which the fuel pump 33 is attached is arranged outside the cylinder head cover 13. Accordingly, unlike the configuration described in the "BACKGROUND OF THE INVENTION" section, in which the bracket is accommodated in the limited space between the cylinder head cover and the cylinder head, the position at which the bracket 31 is installed is not restricted by the components arranged inside the cylinder head cover 13 such as the exhaust camshaft 21, an exhaust cam 22, and the pump drive cam 38. Also, sufficient space is easily ensured to install the bracket 31. In other words, the bracket 31 has improved flexibility in installation thereof.

In the first embodiment, the bracket 31, which is arranged outside the cylinder head cover 13, is mounted on the cylinder head 11 by means of the bolts 32. Further, the stepped surfaces 31*c* are formed on the attachment portions 31*a* of the bracket 31. The stepped surfaces 31*c* press the stepped portions 13*c* of the cylinder head cover 13 against the cylinder head 11. As a result, at the stepped portions 13*c* of the cylinder head cover 13 and the attachment portions 31*a* of the bracket 31, the cylinder head cover 13 and the bracket 31 are fastened and fixed together to the cylinder head 11 by means of the bolts 32. In this manner, the number of the bolts 14 that are used exclusively to fix the cylinder head cover 13 to the cylinder head 11 is decreased. This facilitates mounting and separation of the cylinder head cover 13 and the bracket 31 with respect to the cylinder head 11.

In the first embodiment, the bracket 31, which is arranged outside the cylinder head cover 13, is mounted on the cylinder head 11 by means of the bolts 32. This allows the cylinder head cover 13 to be formed of synthetic resin to reduce the weight of the cylinder head cover 13. Further, since the fuel pump 33 is attached to the bracket 31 formed of metal such as aluminum alloy or magnesium alloy, attachment rigidity of the fuel pump 33 is improved.

In the first embodiment, the sealing member 39 is deployed between the inner peripheral surface of the accommodation tubular portion 13*f* and the outer peripheral surface of the attachment tubular portion 31*d*. In other words, the sealing member 39 is received inside the cylinder head cover 13 and thus prevented from being contaminated.

In the first embodiment, the spaces G1 and G2 are formed between the top surface of the cylinder head cover 13 and the lower surface of the bracket 31. This prevents the heat inside the cylinder head cover 13 from being transmitted directly to the bracket 31. The bracket 31 is thus prevented from being thermally deteriorated through a temperature rise in the bracket 31 caused by the heat inside the cylinder head cover 13. Also, heat release from the bracket 31 contributes to prevention of excessive heating of the cylinder head 11.

Second Embodiment

A second embodiment of the present invention will now be described with reference to FIGS. 4 to 6. Same or like reference numerals are given to components of the second embodiment that are the same as or like corresponding components of the first embodiment. Description of the components is omitted or simplified herein.

Figure 4:
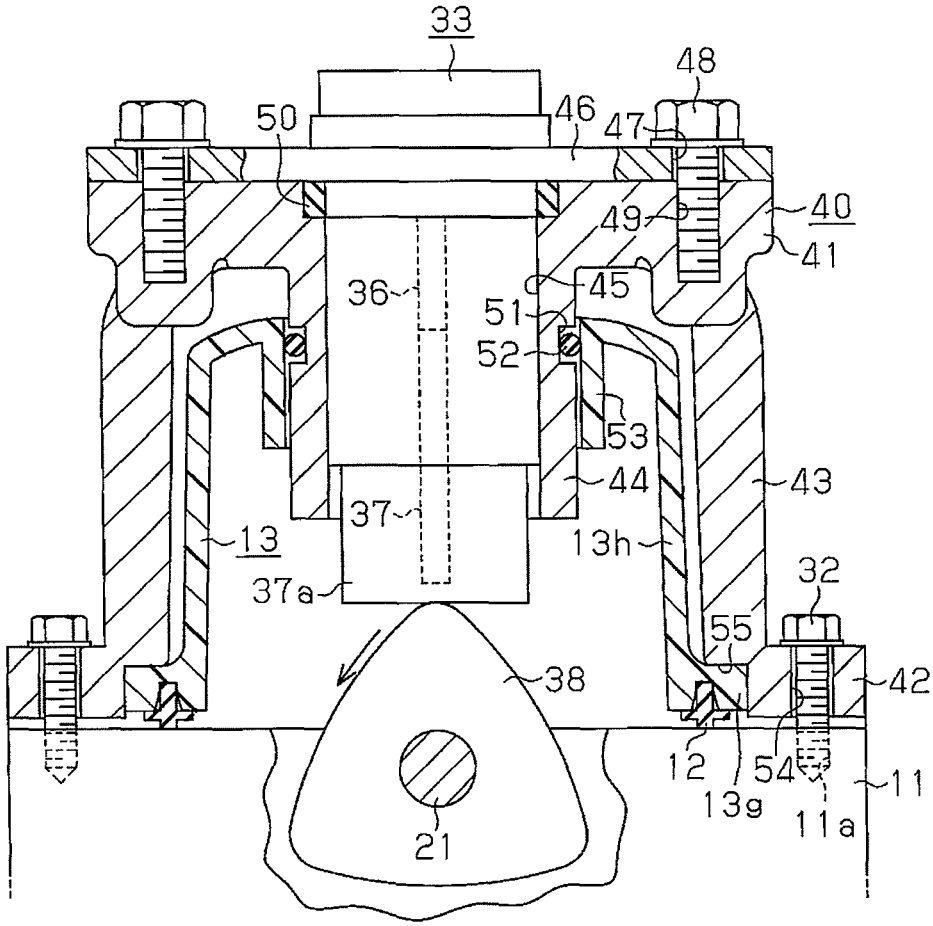
FIG. 4 is a cross-sectional view showing a fuel pump attachment structure according to a second embodiment of the present invention.
Figure 5:
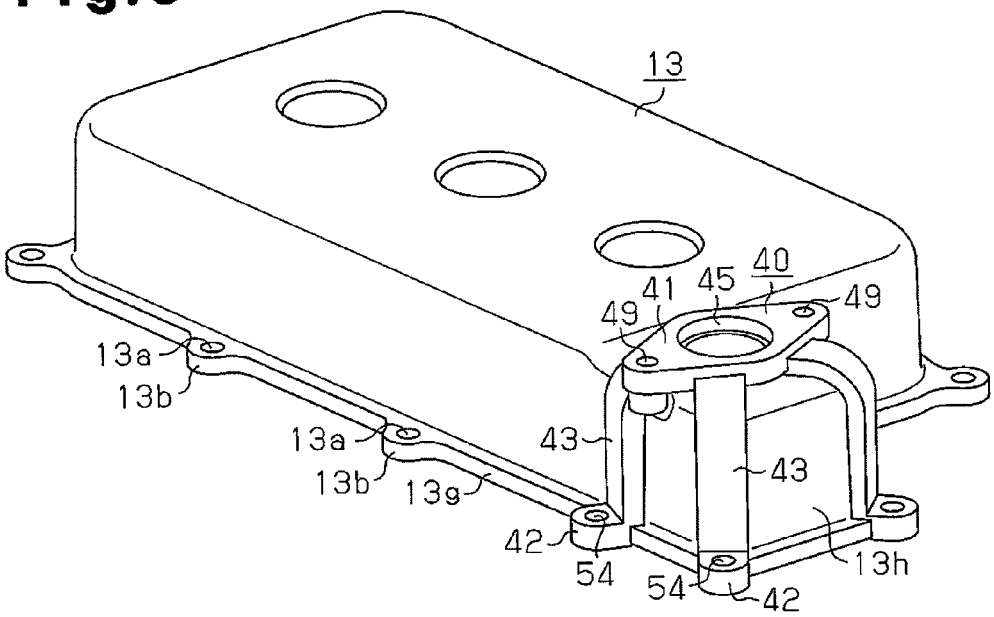
FIG. 5 is a perspective view showing the fuel pump attachment structure illustrated in FIG. 4 with a bracket mounted to a cylinder head cover.

As illustrated in FIGS. 4 and 5, a flange 13*g* is formed along the outer periphery of the lower end of the cylinder head cover 13. The cylinder head cover 13 has attachment portions 13*b* each having a through hole 13*a*. The attachment portions 13*b* are formed integrally with the flange 13*g*. With reference to FIG. 6, as viewed from above, the cylinder head cover 13 has a rectangular shape with one corner missing. The cylinder head cover 13 has an extended portion 13*h*, which extends laterally. The extended portion 13*h* is shaped like a lidded rectangular box. A portion (a pressed portion) of the flange 13*g* that is provided around the extended portion 13*h* includes neither a through hole 13*a* nor an attachment portion 13*b*. The cylinder head cover 13 is formed of synthetic resin such as polyamide resin.

A bracket 40 for supporting the fuel pump 33 is mounted to the cylinder head cover 13 in a manner straddling the extended portion 13*h* of the cylinder head cover 13. The bracket 40 has a rhomboid-shaped bracket body 41 and four reverse-L-shaped legs 43, which each extend downward from a corresponding one of the four side surfaces of the bracket body 41. An attachment portion 42 is formed at the lower end of each of the legs 43. The bracket 40 is formed of metal such as aluminum alloy or magnesium alloy.

As illustrated in FIG. 4, the bracket 40 has a cylindrical attachment tubular portion 44, which is arranged at the center of the bracket body 41 and projects downward from the inner surface of the bracket body 41. The attachment tubular portion 44 is formed integrally with the bracket body 41. The attachment tubular portion 44 has a through hole 45, which extends in the upward-downward direction. The fuel pump 33 is inserted into the through hole 45. The fuel pump 33 has a flange 46 formed integrally with an upper portion of the fuel pump 33. The flange 46 is supported by the bracket 40 with the lower surface of the flange 46 held in contact with the top surface of the bracket body 41. Bolt insertion holes 47 are formed in the flange 46. A bolt 48 is inserted into each of the bolt insertion holes 47 of the flange 46 and threadably received in a corresponding one of threaded holes 49, which are formed in the bracket body 41. This fixes the fuel pump 33 to the bracket 40.

The diameter of an upper end portion of the through hole 45 in the bracket 40 is increased and a sealing member 50 is received in the upper end portion of the through hole 45. The sealing member 50 seals the gap between the outer peripheral surface of the fuel pump 33 and the inner peripheral surface of the bracket body 41 (that is, the inner peripheral surface of the attachment tubular portion 44). An annular groove 51 is formed in the outer peripheral surface of the attachment tubular portion 44. A sealing member 52 is arranged in the annular groove 51. An accommodation tubular portion 53 in which the attachment tubular portion 44 is inserted from above is provided at the center of the extended portion 13*h* of the cylinder head cover 13 and projects downward from the inner surface of the extended portion 13*h*. The sealing member 52 seals the gap between the accommodation tubular portion 53 of the cylinder head cover 13 and the attachment tubular portion 44 of the bracket 40.

Each one of the attachment portions 42 of the bracket 40 extends perpendicularly outward from the lower end of a corresponding one of the legs 43. A bolt insertion hole 54 is formed in each of the attachment portions 42. A stepped surface 55 (a pressing portion) is formed on the inner side of each attachment portion 42, or, in other words, at the lower end of each leg 43. The stepped surfaces 55 are located at positions corresponding to the portion of the flange 13*g* that is provided around the extended portion 13*h* of the cylinder head cover 13. Specifically, with the bracket 40 arranged in the manner straddling the extended portion 13*h* of the cylinder head cover 13, the stepped surfaces 55 of the bracket 40 are held in contact with the portion of the flange 13*g* that is provided around the extended portion 13*h*. In this state, the bolts 32 are inserted into the corresponding bolt insertion holes 54 and threadably received in corresponding threaded holes 11*a* formed in the cylinder head 11. In this manner, the bracket 40 and the cylinder head cover 13 are fastened and fixed together to the cylinder head 11 through the bolts 32.

In this case, the stepped surfaces 55 of the bracket 40 depress the flange 13*g* of the cylinder head cover 13, thus compressing the gasket 12. The cylinder head cover 13 and the bracket 40 are thus effectively joined together. As has been described, the extended portion 13*h* of the cylinder head cover 13 is shaped like a lidded rectangular box. Corner portions of the flange 13*g* that correspond to two corners of the extended portion 13*h* are pressed against the cylinder head 11 through the corresponding stepped surfaces 55 of the bracket 40. The cylinder head cover 13 and the bracket 40 are thus firmly fixed to the cylinder head 11.

Figure 6:
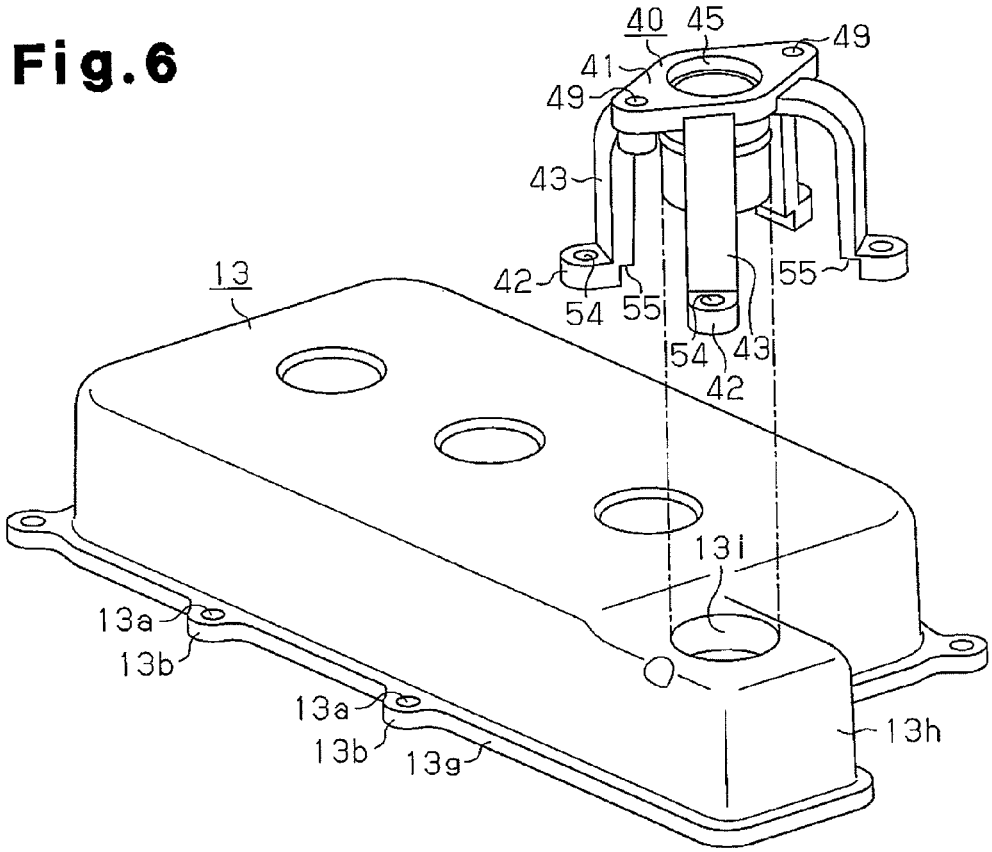
FIG. 6 is an exploded perspective view showing the fuel pump attachment structure illustrated in FIG. 4 before the bracket is mounted to the cylinder head cover.

Specifically, with reference to FIGS. 5 and 6, to mount the bracket 40 in the cylinder head 11, the bracket 40 is arranged in the manner straddling the extended portion 13*h* of the cylinder head cover 13. At this stage, as illustrated in FIG. 4, the stepped surfaces 55 of the bracket 40 are brought into contact with the portion of the flange 13*g* that is provided around the extended portion 13*h*. In this state, the bolts 32 are each inserted into the bolt insertion hole 54 of a corresponding one of the attachment portions 42 and threadably received in a corresponding one of the threaded holes 11*a* of the cylinder head 11. In this manner, the bracket 40 is mounted in the cylinder head 11. As a result, with the cylinder head cover 13 pressed against the cylinder head 11 through the bracket 40, the bracket 40 and the cylinder head cover 13 are simultaneously mounted in the cylinder head 11.

Then, the fuel pump 33 is inserted into the through hole 45 of the bracket 40 and the flange 46 of the fuel pump 33 is supported on the bracket 40. In this state, the bolts 48 are inserted into the corresponding bolt insertion holes 47 of the flange 46 and threadably received in the corresponding threaded holes 49 of the bracket body 41. The fuel pump 33 is thus attached to the cylinder head 11.

The fuel pump attachment structure according to the second embodiment has the advantages described below, in addition to advantages similar to those obtained by the fuel pump attachment structure according to the first embodiment.

In the second embodiment, as viewed from above, the cylinder head cover 13 is shaped like a rectangle with one corner missing. As a result, the weight and size of the cylinder head cover 13 are reduced by an amount corresponding to the missing corner.

The bracket 40 has the multiple attachment portions 42 and the stepped surfaces 55 are formed on the inner sides of the corresponding attachment portions 42. The stepped surfaces 55 press the portion of the flange 13*g* that is provided around the extended portion 13*h* of the cylinder head cover 13 against the cylinder head 11. In this state, the bolts 32 inserted into the bolt insertion holes 54 in the attachment portions 42 fix the bracket 40 to the cylinder head 11. As a result, the stepped surfaces 55, which are formed in the attachment portions 42 of the bracket 40, press the flange 13*g* of the cylinder head cover 13 against the cylinder head 11 from immediately above. This effectively fixes the bracket 40, together with the cylinder head cover 13, to the cylinder head 11.

The extended portion 13*h* of the cylinder head cover 13 is shaped like a lidded rectangular box. The stepped surfaces 55 of the bracket 40 press at least the corner portions of the flange 13*g* that correspond to two corners of the extended portion 13*h* against the cylinder head 11. As a result, the stepped surfaces 55 effectively press the flange 13*g* of the cylinder head cover 13, thus effectively fixing the cylinder head cover 13 and the bracket 40 to the cylinder head 11.

The cylinder head cover 13 is formed of synthetic resin. However, since the extended portion 13*h* of the cylinder head cover 13 is reinforced by the bracket 40, it is unnecessary to reinforce the cylinder head cover 13.

Modifications

The illustrated embodiments may be modified according to the forms described below.

Figure 7A:
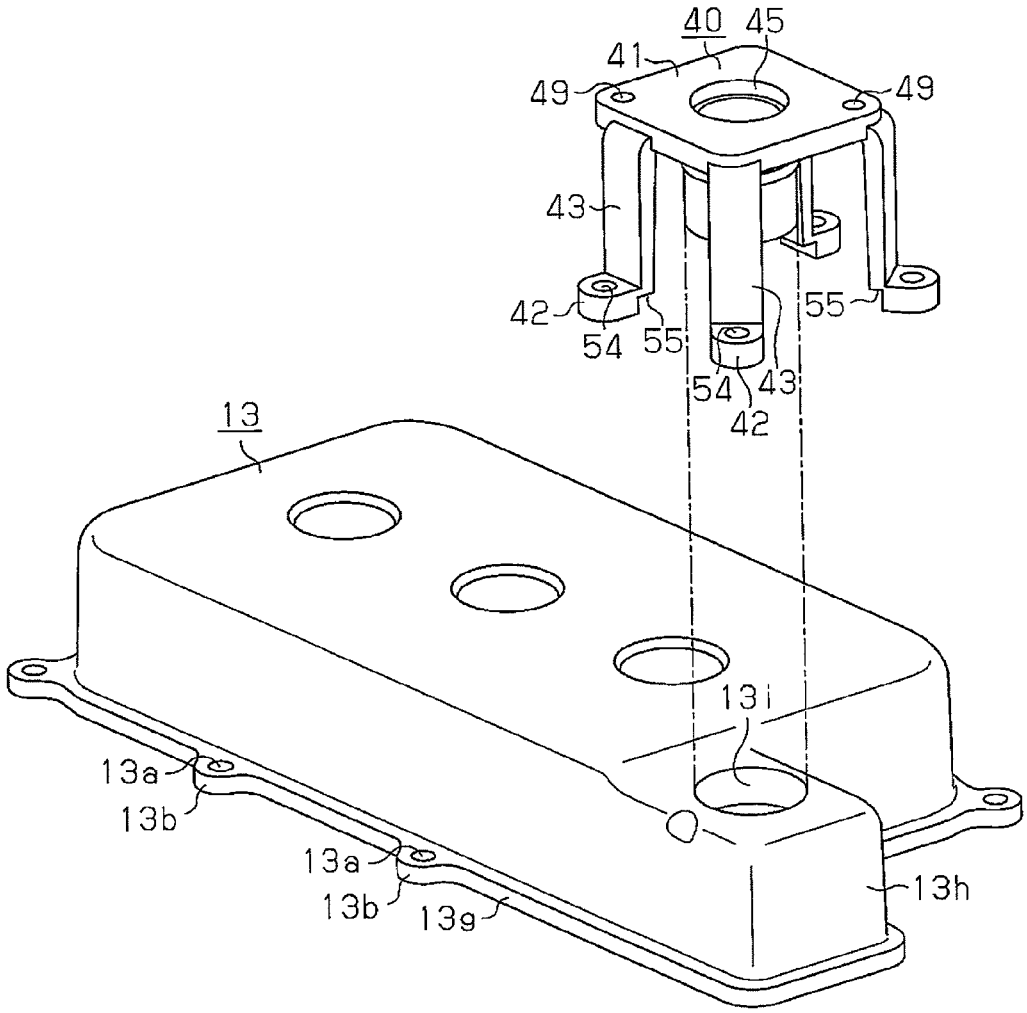
FIG. 7(*a*) is an exploded perspective view showing a modification of the fuel pump attachment structure according to the second embodiment before a bracket is mounted to a cylinder head cover.
Figure 7B:
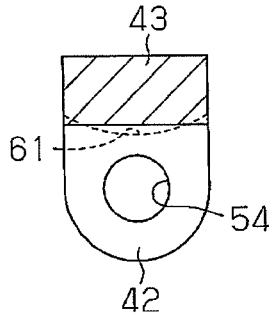

As illustrated in FIG. 7(*a*), the bracket body 41 may be formed in a square shape. Two of the attachment portions 42 are arranged at corresponding corners of the bracket body 41. The other two of the attachment portions 42 are arranged at corresponding sides of the bracket body 41. In this case, the stepped surfaces 55 formed in the attachment portions 42 at the two corners of the bracket body 41 press corresponding corner portions of the flange 13*g* that correspond to two corners of the extended portion 13*h* of the cylinder head cover 13 from above. The stepped surfaces 55 formed in the attachment portions 42 at the two sides of the bracket body 41 press corresponding straight portions of the flange 13*g* that correspond to two opposite sides of the extended portion 13*h* of the cylinder head cover 13 from above by a large contact surface area.

As to the legs 43 formed in the bracket 40 illustrated in FIG. 7(*a*), the attachment portions 42 of the two legs 43 at the associated corners of the bracket body 41 may have an inner surface 61, which is an arcuate surface projecting outward as illustrated in FIG. 7(*b*). In this case, the stepped surfaces 55 of these two attachment portions 42 press the corner portions of the flange 13*g* that correspond to two corners of the extended portion 13*h* of the cylinder head cover 13 from above by an increased contact surface area.

Figure 8:
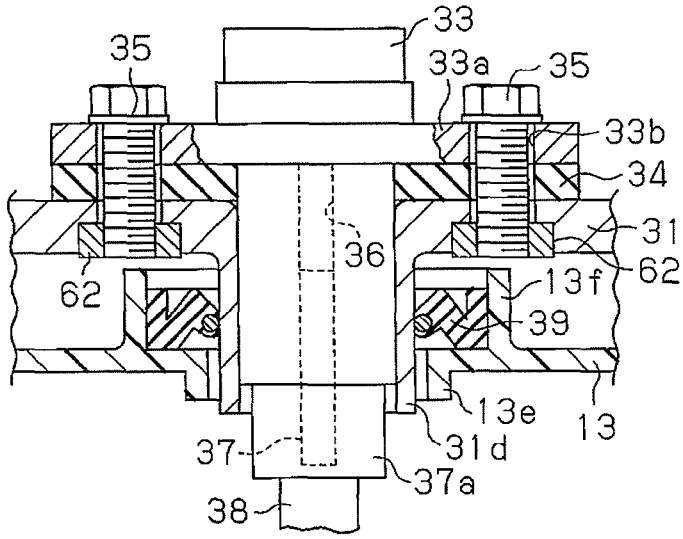
FIG. 8 is a vertical cross-sectional view showing a portion of a modification of the fuel pump attachment structure according to the first embodiment.

The accommodation tubular portion 13*f*, which is formed integrally with the cylinder head cover 13, may be formed in a manner projecting from the top surface of the cylinder head cover 13 as illustrated in FIG. 8, instead of projecting from the lower surface of the cylinder head cover 13 as illustrated in FIG. 2. In other words, the accommodation tubular portion 13*f* may be arranged not inside but outside the cylinder head cover 13. As illustrated also in FIG. 8, the opening 13*e* of the cylinder head cover 13 may be formed in a manner extending from the lower surface of the cylinder head cover 13, or, in other words, inside the cylinder head cover 13. In this case, the sealing member 39 is placed and received in the accommodation tubular portion 13*f* from above. Further, with reference to FIG. 8, nuts 62, each of which threadably engages a corresponding one of the bolts 35, may be embedded in the bracket 31. In the modification illustrated in FIG. 8, the impact caused by the plunger 37 at the time when the plunger 37 is raised through rotation of the pump drive cam 38 is adequately dispersed through the bolts 35 and the nuts 62.

Figure 9:
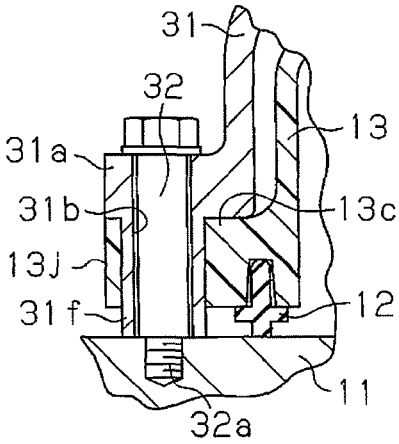
FIG. 9 is a vertical cross-sectional view showing a portion of a modification of the fuel pump attachment structure according to the first embodiment.

As illustrated in FIG. 9, a small-diameter tubular portion 31*f* may be formed in a lower portion of each of the attachment portions 31*a* of the bracket 31. Large-diameter tubular portions 13*j*, each of which is arranged around a corresponding one of the tubular portions 31*f*, may be formed in a corresponding one of the stepped portions 13*c* of the cylinder head cover 13. The tubular portions 31*f* of the bracket 31 are formed integrally with the bracket 31. The tubular portions 13*j* of the cylinder head cover 13 are formed integrally with the cylinder head cover 13. Each of the tubular portions 31*f* of the bracket 31 is fitted in a corresponding one of the tubular portions 13*j* of the cylinder head cover 13 and held in contact with the top surface of the cylinder head 11. The bolts 32 are inserted into the corresponding tubular portions 31*f* of the bracket 31. In the modification illustrated in FIG. 9, engagement between the tubular portions 13*j* and the tubular portions 31*f* connects the bracket 31 firmly to the cylinder head cover 13.

Figure 10:
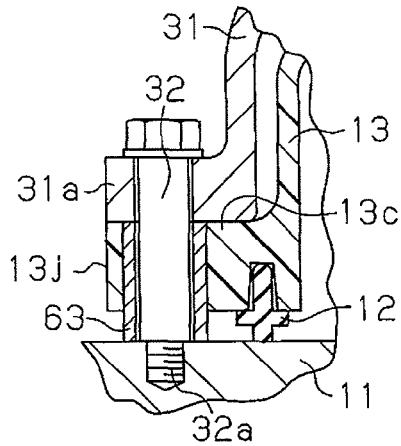
FIG. 10 is a vertical cross-sectional view showing a portion of a modification of the fuel pump attachment structure according to the first embodiment.
Figure 11:
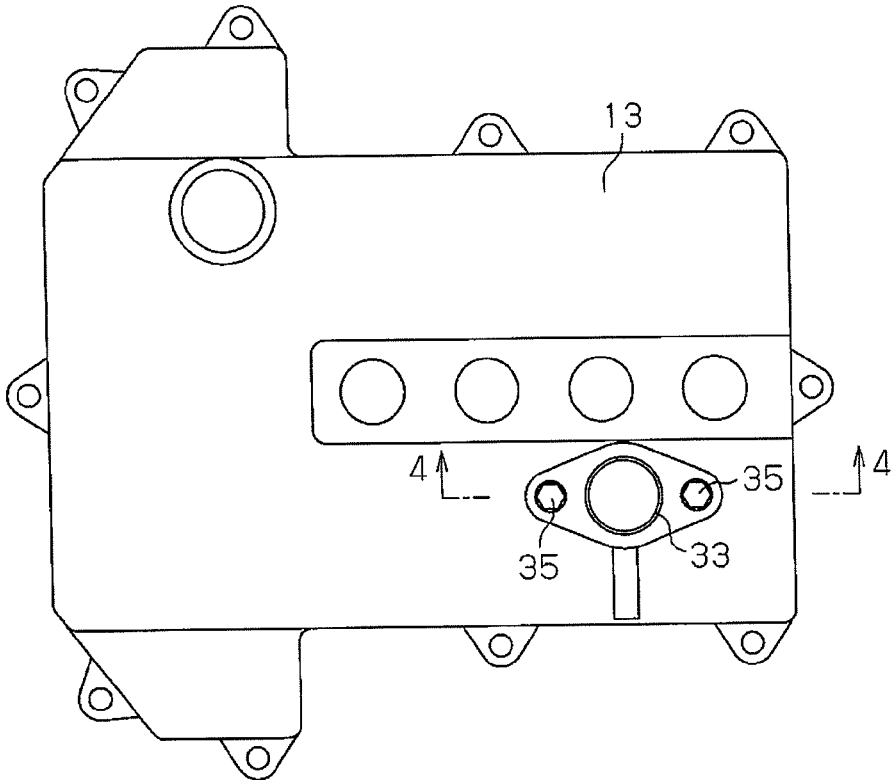
FIG. 11 is a plan view showing a conventional fuel pump attachment structure.
Figure 12:
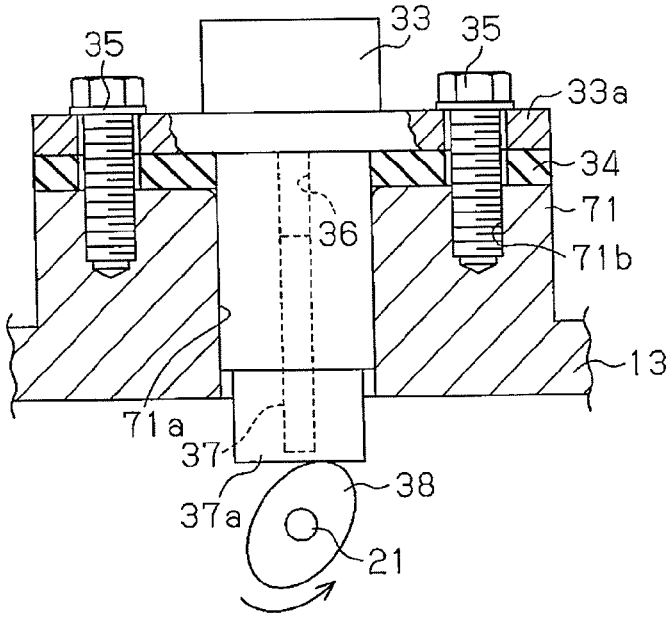
FIG. 12 is a cross-sectional view taken along line 4-4 of FIG. 11.

Instead of the tubular portions 31*f* in the bracket 31 in the modification illustrated in FIG. 9, tubular collars 63, each of which is fitted in a corresponding one of the tubular portions 13*j* of the cylinder head cover 13, may be arranged between the top surface of the cylinder head 11 and the lower surfaces of the corresponding attachment portions 31*a* (pressing portions) of the bracket 31, as illustrated in FIG. 10. In the embodiment illustrated in FIG. 10, the collars 63 improve rigidity of the bracket 31.

The bracket 31 or the bracket 40 may be formed of highly rigid heat-resistant resin material or ceramic material.

The sealing member 34 or the sealing member 39 may be formed by an O ring.

The shape of the cylinder head cover 13 illustrated in FIGS. 4 to 6 is not restricted to the rectangle with one corner missing as viewed from above. In other words, the cylinder head cover 13 does not necessarily have to include the extended portion 13*h*. In this modification, the bracket 40 is installed outside the cylinder head cover 13 at a position other than the position corresponding to the extended portion 13*h*.

The invention claimed is:

1. A fuel pump attachment structure comprising:

a cylinder head;

a cylinder head cover joined to a top surface of the cylinder head;

a bracket mounted to the top surface of the cylinder head so as to be located at a position outside the cylinder head cover; and a fuel pump attached to the bracket, wherein the fuel pump is provided in an opening defined in the cylinder head cover, a first sealing member is arranged between an outer surface of the fuel pump and a surface of the cylinder head cover that defines the opening, the bracket has an attachment tubular portion into which the fuel pump is accommodated, a second sealing member is arranged between the attachment tubular portion and the fuel pump, the cylinder head cover has an accommodation tubular portion that is arranged at one of an inside or an outside of the cylinder head cover and defines the opening, the attachment tubular portion is provided in the accommodation tubular portion, and the first sealing member is arranged between an outer surface of the attachment tubular portion and an inner surface of the accommodation tubular portion.

2. The fuel pump attachment structure according to claim 1, wherein the cylinder head cover and the bracket are fixed to the cylinder head using a common bolt.

3. The fuel pump attachment structure according to claim 2, wherein the bracket has a pressing portion for pressing a pressed portion formed on a periphery of the cylinder head cover from above.

4. The fuel pump attachment structure according to claim 3, wherein the bracket has a tubular portion formed integrally with the bracket, the common bolt is provided in the tubular portion, another tubular portion that is arranged around the tubular portion of the bracket is formed in the cylinder head cover, the tubular portion of the bracket is held in contact with the top surface of the cylinder head in a state fitted in the tubular portion of the cylinder head cover, and the tubular portion of the cylinder head cover functions as the pressed portion.

5. The fuel pump attachment structure according to claim 3, wherein the cylinder head cover has a tubular portion, a tubular collar is fitted in the tubular portion, the common bolt is provided in the collar, the collar is arranged between a lower surface of the pressing portion of the bracket and the top surface of the cylinder head, and the tubular portion of the cylinder head cover functions as the pressed portion.

6. A fuel pump attachment structure comprising:

a cylinder head;

a cylinder head cover joined to a top surface of the cylinder head;

a bracket mounted to the top surface of the cylinder head so as to be located at a position outside the cylinder head cover; and a fuel pump attached to the bracket, wherein the fuel pump is provided in an opening defined in the cylinder head cover, a first sealing member is arranged between an outer surface of the fuel pump and a surface of the cylinder head cover that defines the opening, the cylinder head cover is shaped in such a manner that a portion of the cylinder head cover appears to be a cutout, the cylinder head cover has an extended portion that extends laterally, and the bracket is mounted to the cylinder head cover in a manner straddling the extended portion.

7. The fuel pump attachment structure according to claim 6, wherein the bracket has a leg, a stepped surface is formed at a lower end of the leg, and the stepped surface is held in contact with a flange provided around the extended portion and presses the cylinder head cover against the cylinder head.

8. The fuel pump attachment structure according to claim 7, wherein the extended portion is shaped like a lidded rectangular box, and the stepped surface is held in contact with at least a portion of the flange that corresponds to a corner of the extended portion and presses the cylinder head cover against the cylinder head.

9. A fuel pump attachment structure comprising:

a cylinder head;

a cylinder head cover joined to a top surface of the cylinder head;

a bracket mounted to the top surface of the cylinder head so as to be located at a position outside the cylinder head cover; and a fuel pump attached to the bracket, wherein a pressing portion is formed in a lower portion of the bracket, the pressing portion pressing a pressed portion formed on a periphery of the cylinder head cover from above by means of a bolt that is inserted into the pressing portion and fastened to the cylinder head.

10. The fuel pump attachment structure according to claim 9, wherein the pressed portion of the cylinder head cover is a flange, the pressing portion of the bracket is a stepped surface, and the stepped surface of the bracket contacts the flange of the cylinder head and presses the cylinder head cover against the cylinder head.

11. The fuel pump attachment structure according to claim 9, wherein the cylinder head cover is shaped in such a manner that a portion of the cylinder head cover appears to be a cutout, the cylinder head cover has an extended portion that extends laterally, and the bracket is mounted to the cylinder head cover in a manner straddling the extended portion.

12. The fuel pump attachment structure according to claim 11, wherein the bracket has a leg, a stepped surface is formed at a lower end of the leg, and the stepped surface is held in contact with a flange provided around the extended portion and presses the cylinder head cover against the cylinder head.

13. The fuel pump attachment structure according to claim 11, wherein the extended portion is shaped like a lidded rectangular box, and the stepped surface is held in contact with at least a portion of the flange that corresponds to a corner of the extended portion and presses the cylinder head cover against the cylinder head.

* * * * *